US006176243B1

(12) United States Patent
Blunk

(10) Patent No.: US 6,176,243 B1
(45) Date of Patent: Jan. 23, 2001

(54) COMPOSITION FOR PARAFFIN REMOVAL FROM OILFIELD EQUIPMENT

(76) Inventor: Joe A. Blunk, Rte. 4, Box 769, Galena, MO (US) 65656

( * ) Notice: Under 35 U.S.C. 154(b), the term of this patent shall be extended for 0 days.

(21) Appl. No.: 09/277,904

(22) Filed: Mar. 29, 1999

Related U.S. Application Data

(60) Provisional application No. 60/079,968, filed on Mar. 30, 1998.

(51) Int. Cl.[7] ..... B01F 3/12; B08B 9/00; C11D 1/72

(52) U.S. Cl. ..... 134/22.19; 134/40; 507/931; 510/188; 510/421; 516/30; 516/75; 516/76

(58) Field of Search ..... 516/30, 75, 76; 507/931; 510/188, 421; 134/22.19

(56) References Cited

U.S. PATENT DOCUMENTS

| | | | | |
|---|---|---|---|---|
| 3,535,160 | * | 10/1970 | Arger | 134/22.19 |
| 3,718,586 | | 2/1973 | Rollo et al. . | |
| 3,777,820 | | 12/1973 | Weaver et al. | 166/305 R |
| 4,005,020 | | 1/1977 | McCormick . | |
| 4,110,283 | | 8/1978 | Capelle . | |
| 4,511,488 | * | 4/1985 | Matta | 510/421 |
| 4,620,937 | * | 11/1986 | Dellutri | 510/421 X |
| 4,668,408 | | 5/1987 | McClaflin et al. . | |
| 4,669,544 | | 6/1987 | Nimerick | 166/300 |
| 4,693,312 | | 9/1987 | Lenderman | 166/279 |
| 4,722,398 | | 2/1988 | Bohlen et al. | 166/304 |
| 4,764,285 | * | 8/1988 | Robbins et al. | 516/76 X |
| 4,925,497 | | 5/1990 | Thierheimer, Jr. | 134/40 |
| 4,934,457 | | 6/1990 | Wallender | 166/304 |
| 4,937,007 | | 6/1990 | Damin et al. . | |
| 4,997,580 | | 3/1991 | Karydas et al. . | |
| 5,053,149 | | 10/1991 | McElligot, Jr. et al. . | |
| 5,183,581 | | 2/1993 | Khalil et al. . | |
| 5,244,566 | * | 9/1993 | Bond | 516/76 X |
| 5,271,773 | * | 12/1993 | Hamilton et al. | 510/421 X |
| 5,336,428 | * | 8/1994 | Kaplan et al. | 510/188 |
| 5,389,156 | * | 2/1995 | Mehta et al. | 134/22.19 X |
| 5,399,282 | * | 3/1995 | Hansen et al. | 510/421 X |
| 5,407,899 | * | 4/1995 | Howell | 516/75 X |
| 5,484,488 | | 1/1996 | Hart et al. | 134/22.13 |
| 5,552,089 | * | 9/1996 | Misselyn et al. | 516/75 X |
| 5,856,289 | * | 1/1999 | Kennedy | 510/421 X |

* cited by examiner

*Primary Examiner*—Richard D. Lovering
(74) *Attorney, Agent, or Firm*—Jonathan A. Bay

(57) ABSTRACT

A non-hazardous, non-flammable, biodegradable composition for use in removal of paraffin accumulations in oilfield equipment may contain limonene, a glycol ether an ethoxylate(alcohol surfactant, an aliphatic alcohol having 1 to 4 carbon atoms or mixtures thereof, a non-hazardous and biodegradable organic acid, and, sufficient water as a carrier and comprising such a major weight component of the composition as to virtually eliminate a measurable flashpoint therefor. Preferably the aliphatic alcohol is one or methanol, ethanol, or admixtures thereof. Preferably the organic acid is one of acetic acid, citric acid, or formic acid. The glycol either is preferably ethylene glycol monopropyl ether.

14 Claims, No Drawings

COMPOSITION FOR PARAFFIN REMOVAL FROM OILFIELD EQUIPMENT

CROSS-REFERENCE TO PROVISIONAL APPLICATION(S)

This application claims the benefit of U.S. Provisional Application No. 60/079,968, filed Mar. 30, 1998.

BACKGROUND OF THE INVENTION

1. Field of the Invention

The invention generally relates to compositions for cleaning contaminant deposits or accumulations from oilfield equipment, and methods of use thereof. For convenience in this description, the contaminant deposits or accumulations are termed "paraffin," paraffinic," and/or "paraffin-like" deposits, which terms are used interchangeably throughout the specification to refer to any material which is insoluble, sparingly soluble, or undispersible in crude oil under conditions of production.

Thus, a given "paraffinic" deposit—in accordance with the terminology herein—may contain high molecular weight aliphatic hydrocarbons (eg., generally having more than about 20 carbon atoms), petroleum resins, asphaltic and asphaltene materials, aromatic hydrocarbons, water, and inorganic matter (such as calcium and magnesium carbonates and sulfates, sand, clay and silicates, rust, iron sulfide, chlorides &c.), and the like. As will be understood by persons ordinarily skilled in the art, the composition of such deposits varies from one crude oil to another, from one field to another and from well to another well in the same field.

2. Prior Art

The accumulation of paraffin on oilfield equipment constitutes an example of precipitation and deposition. Crude oil in the formation is a solution combining the higher molecular weight, paraffinic hydrocarbons with lower molecular weight hydrocarbons which function as solvents. The higher molecular weight, paraffinic solids precipitate whenever the lower molecular weight hydrocarbons transport capacity is reduced. Generally, if the temperature of the crude oil in the formation cools (and/or its pressure decreases), then it can be expected that the higher molecular weight, paraffinic hydrocarbons solids will precipitate and form accumulative deposits.

Paraffin deposition and accumulation is gradual, leading to differential distribution of different chain lengths according to temperature and pressure changes with (i) the fractional amount of the higher-molecular weight paraffin-containing crude oil in the bore, (ii) the pumping thereof, (iii) its transport in conduits, and (iv) its storage in tanks and so on. Consequently, paraffinic deposition and accumulation can and does occur about anywhere in the oil-extraction and -refining process, and plainly is pervasive to oilfield equipment and the associated environment:—it forms and accumulates in such places as on the face of the producing formation, in the casing or the tubing of the well, in oil flowlines and pipelines, in the pump(s), in tank batteries, tank farms and the like.

Paraffin deposits operate to decrease materially the productivity of the wells in which they occur, or decrease materially the capacity of the pipes through which they flow, and so on. Sometimes the deposits accumulate to the point little or no flow can pass through such conduits under normal manner of operation.

The purpose of removing such deposits is obvious. In some areas, wells decline in productivity at a more or less rapid rate because of build-up of such paraffin deposits. In some instances, the decline is sufficient that the wells must be serviced at a frequency ranging from several days to several weeks. In other instances the deposition is slow and hence servicing at longer intervals is sufficient to maintain the well at a satisfactory level of productivity. The same is true of the various conduits through which the oil travels from the well to the refinery:—including through tank batteries, tank farms, pipes and so on. The capacity of a conduit of circular cross-section is reduced greatly by such deposits. The conduit's capacity is frequently reduced to a small fraction of its capacity clean. For example, an operator may find himself burdened with the cost of a 6 or 8 inch (15 or 20 cm) flowline, yet seeing that flowline achieve a capacity equal merely to that of a 3 or 4 inch (8 or 10 cm) Flowline because of paraffinic deposits lining the inside surface of the conduit and constricting the flow area. Ultimately such conduits may be found virtually clogged by such deposits.

Paraffinic deposits likewise occur on formation wells, where this phenomena of inward accretion constricting the flow area is also experienced. If the casing provides nominally an 8 inch (20 cm) diameter flow area when clean, then a 1 inch (2.5 cm) lining of paraffin constricts the effective diameter to 6 inches (15 cm). The effective flow area is reduced by half. If the line pressure were 1,000 psi (70 bar) for line when clean, then the line when fouled and constricted in half will have twice the line pressure, or about 2,000 psi (135 bar). Several aggravating conditions set up when this happens. A local venturi is created, and this promotes erosion of the casing, which sometimes can erode away to allow a leak spot in the casing. Well productivity vis-α-vis line constriction or leakage may fall substantially to zero, especially in low-pressure fields. As for tank capacities, tank capacities are also reduced by such deposits where a layer may cover the bottom to a depth of several feet.

Various techniques have been employed for the removal of paraffin deposits from oil-producing formations and wells penetrating such formations. These techniques include the use of mechanical and heating devices, explosives, solvents, and so on. Over 50% of the cost of producing and marketing oil from producing wells is related to cleaning procedures to break-up and remove paraffin. The two most common techniques are mechanical scraping and hot-oil flushing. Mechanical scraping, with specially designed instruments, is sometimes also referred to as "knifing." Scraping—where available—is labor-intensive, time-consuming, and generally, expensive. Also, scraping is not available when removal of the paraffin is required from pumps, valves and the like. Hot oil treatments are also expensive because of the considerable cost in the energy-consumption for heating, pumping and the like, and besides, hot oil has a relatively low solvency for paraffin and hence is generally less effective treatment for the dollar. By either foregoing technique/treatment, the removed paraffin usually remains in a solid form or quickly returns to a solid form after treatment.

Chemical methods are effective for dissolving or dispersing paraffin deposits in oil. Normally, paraffin removal is effected through the aid of solvents or surface agents. However it is also known to set up highly-exothermic acid reactions for generating and applying heat to the paraffin solids, but in these cases the paraffin is not truly dissolved and dispersed, and can again quickly return to a solid form after the heat dissipates.

Paraffinic solvents dissolve deposits, but their action is limited, however, to the deposit surface, while surface agents lower surface tension and chemically enwrap small particles, thus changing their adhesion capacity mutually among one another or their adhesion capacity to flowline (eg., pipe) surfaces. Thus broken up, such smaller paraffin particles more easily remain oil-suspended and move freely. The presence of a surface agent lowers the water surface tension breaking the link between paraffin molecules and the flowline (eg., metallic pipeline) wall, inhibiting further paraffin deposition, therefore acting secondarily as a preventative compound or "inhibitor."

Shortcomings associated with known chemical methods include that the known chemical compositions are hazardous materials. They require exceptionally special handling because of toxicity, flammability, or outright explosiveness. Workers are advised to wear gloves, goggles, coveralls, splash aprons and in exceptional instances, respirators or scuba gear to handle the known chemicals, and only within safe proximity of showers and eye rinses and the like. Many popular solvents have such low flashpoints that their handling requires diligence not only in preventing a fire hazard but also in avoiding an explosion. Spills are environmental hazards which require immediate containment and clean-up. Generally, a spill of a gallon or so of the typical known chemical requires excavation and removal of all the soil absorbed with the chemical. Also, the addition of many of the toxic forms of chemicals requires containment and treatment of the removed sludge once it is drawn off the oilfield equipment being treated.

What is needed is a substantially safe product which is substantially non-toxic and non-flammable, and substantially bio-degradable, such that it obviates the special handling attendant to use of the prior art chemicals.

SUMMARY OF THE INVENTION

It is an object of the invention to provide a composition for removing paraffin from oilfield equipment which is substantially non-hazardous.

It is an alternate object of the invention to provide a composition for removing paraffin from oilfield equipment which is substantially non-flammable.

It is an additional object of the invention to provide a composition for removing paraffin from oilfield equipment which is substantially bio-degradable.

These and other objects and aspects in accordance with the invention are provided by a non-hazardous, non-flammable, biodegradable composition for use in removal of paraffin accumulations in oilfield equipment may contain limonene, a glycol ether, an ethoxylated alcohol surfactant, an aliphatic alcohol having 1 to 4 carbon atoms or mixtures thereof, a non-hazardous and biodegradable organic acid, and, sufficient water as a carrier and comprising such a major weight component of the composition as to virtually eliminate a measurable flashpoint therefor. Preferably the aliphatic alcohol is one or methanol. ethanol, or admixtures thereof. Preferably the organic acid is one of acetic acid, citric acid, or formic acid. The glycol ether is preferably ethylene glycol monopropyl ether.

In a more preferential embodiment of the composition in accordance with the invention. the components appear in the following relative weight percentages of about $1/3^{rd}$ of a percentage point of weight percent of the limonene, about 3 weight percent of the ethylene glycol monopropyl ether, about 1 weight percent of the ethoxylated alcohol surfactant, about $1/3^{rd}$ of a percentage point of weight percent of the aliphatic alcohol, about $1/3^{rd}$ of a percentage point of weight percent of the organic acetic acid; and, about 95 weight percent of the water carrier.

The ethoxylated alcohol surfactant more preferably comprises an ethoxylated lauryl alcohol or ethoxylated oleyl alcohol and, even more preferably, having something less than fifteen (15) units of ethylene oxide on the ethoxylated alcohol.

Additional aspects and objects of the invention will be apparent in connection with the discussion further below of preferred embodiments and examples.

DETAILED DESCRIPTION OF THE PREFERRED EMBODIMENTS

The present invention relates to a novel composition and improved method for paraffin removal from oilfield equipment.

The novel composition comprises a non-hazardous, non-flammable and biodegradable aqueous-based mixture of limonene, a glycol ether, an ethoxylated alcohol surfactant, an aliphatic alcohol having 1 to 4 carbon atoms (or mixtures thereof), and, an aliphatic acid having 1 to 4 carbon atoms (or mixtures thereto). Preferentially the water, carrier-component of the inventive composition comprises such a major weight component of the inventive composition as to virtually eliminate a measurable flashpoint therefor.

The water carrier aside, the major component of the inventive composition is preferably the glycol ether component. Representative candidate glycol ethers include ethylene glycol monomethyl ether, ethylene glycol monoethyl ether, ethylene glycol monopropyl ether, ethylene glycol monobutyl ether, diethylene glycol monomethyl ether, diethylene glycol monoethyl ether (DE), diethylene glycol monopropyl ether (DP), diethylene glycol mono-n-butyl ether (DB), methoxytriglycol, methoxytriglycol, butyltriglycol, propylene glycol monomethyl ether, propylene glycol monobutyl ether, dipropylene glycol monomethyl ether (DPM), and tripropylene glycol monomethyl ether (TPM).

The preferred glycol ether for incorporation in the novel, non-hazardous, non-flammable and biodegradable aqueous-based composition in accordance with the invention is ethylene glycol monopropyl ether. It is popularly known as a good coupling solvent for resin/water systems and effective for controlling the viscosity of waterborne resins in the polyester-producing industries. It has been found to have comparable advantageous actions for liquefying paraffin deposits in the oilfield environment. Ethylene glycol monopropyl ether is miscible with water over a wide temperature range. Ethylene glycol monopropyl ether is distributed by, among other commercially available sources, the Eastman Chemical Company of Kingsport, Tenn., under the trade name "Eastman EP Solvent."

The alcohol utilized in the composition in accordance with the invention preferably is a lower aliphatic alcohol such as containing from 1 to 4 carbon atoms. It is chosen according to features such as its effect as a wetting agent, its demulsifying actions, and its solubility, freezing point reduction, and so on. Suitable alcohols include methyl, ethyl, isopropyl, n propyl, isobutyl, and n butyl. Most preferred is methyl alcohol, ethyl alcohol, or admixtures therebetween since both methanol and ethanol are relatively inexpensive and are suitably non-hazardous, non-flammable and bio-degradable when appearing in the composition in weight percentage of much less than 10 percent. Methanol moreover is very soluble in water.

The limonene of the present invention synergistically cooperates with the glycol ether and surfactant components of the invention to dissolve, demulsity, and/or disperse oilfield paraffin accumulations. Particularly, the limonene coacts with the glycol ether, the lower aliphatic alcohol, and the ethoxylated alcohol surfactant to break up the paraffin solids at the surfaces thereof so that the surfaces of breaking up particles are water wet and have a water shield to prevent re-aggregation together or re-attachment to and deposition on flowline or equipment surfaces. The action of the limonene allows the mixture of the glycol ether, the lower aliphatic alcohol, and the ethoxylated alcohol surfactant to perform this task to a much greater capability than without the limonene.

The limonene of the present invention, or more specifically d-limonene, is a terpene or cyclic hydrocarbon solvent which occurs naturally in all plants. It is a monocyclic unsaturated terpene which is generally a by-product of the citrus industry, derived from the distilled rind oils of oranges, grapefruits, lemons, and the like. A discussion concerning d-limonene and its derivation from numerous sources is set forth in Kesterson, J. W., "Florida Citrus Oil," Institute of Food and Agriculture Science. University of Florida, December, 1971. D-limonene exhibits low human toxicity and is considered environmentally benign. D-limonene exhibits excellent solubility for the higher bitumen and asphaltene compounds commonly found in paraffin sludges and accumulations. D-limonene is commercially available from Florida Chemical Company and from SMC Glidco Organics.

The novel aqueous-based composition in accordance with the invention preferentially includes a biodegradable surfactant, or wetting and dispersing agent to aid in dispersion. Still more preferentially such a surfactant (eg., wetting or dispersing agent) is chosen from such biodegradable nonionic ethoxylated alcohols as the ethoxylated linear alcohols of the Ethal® LA series of ethoxylated linear alcohols available from Ethox Chemicals Inc., Greenville, S.C. (including more preferentially the Ethal® LA-9 product), or, the ethoxylated oleyl alcohols of the Chemal® OA series of ethoxylated oleyl alcohols, available from Chemax Inc. Greenville, S.C. (including more preferentially the Chemal® OA-9 product). Both the Ethal® LA-9 and the Chemal® OA-9 are believed to be a poly(ethyleneoxide) ether of an 18 carbon alcohol having 9 units of ethylene oxide thereon).

Other suitable biodegradable non-ionic surfactants are the similar ethoxylated linear alcohols of the Tergitol® L series of ethoxylated linear alcohols, available from Union Carbide Corp., Danbury, Conn., including more preferentially the Tergitol® 24-L-60 product. Tergitol® Nonionic Surfactant 24-L-60 is a polyethoxylate of a linear alcohol and an alkoxypolyethoxyethanol) having a formula $RO(CH_2CH_2O)_nH$, wherein R is a mixture of $C_{12}$ and $C_{14}$ linear alcohols and "n" averages about 7.0. Such product has a cloud point of 60° C. for a 1% aqueous solution. Its properties are described in a Tergitol® Surfactants Technical Service Bulletin entitled "Ethoxylate Distribution of Tergitol® 24-L Nonionic Surfactants by Gas Chromatography," issued by the Ethylene Oxide Derivatives Division of Union Carbide Corporation, which carries the date of April, 1987. Other Tergitol® Nonionic Surfactants which may also be employed may be products designated 26-L-60, 24-L-45 and 24-L-75, wherein the 60, 45 and 75 indicate cloud points, in degrees Centigrade.

The addition of an acid is advantageous in that the acid is believed to adjust the poll to work on hard mineral precipitates of (as an example) calcium or magnesium and so on. Representative acids which are consonant with the non-hazardous and bio-degradable objectives of the invention include organic acids including but not limited to acetic acid, formic acid, citric acid, and so on, and mixtures thereof. It is specifically desired to avoid inclusion of such toxic acids as hydrochloric, sulphuric or phosphoric and so on. Most preferred is acetic acid.

The inventive composition operates to break the oil-paraffin-water emulsion, and causes the paraffin partially to dissolve and/or liquefy, and stay dissolved in the oil phase or liquified to allow flow and pumping. Its actions include that it works to lower the surface tension between the paraffin emulsion and water phases so that the paraffin emulsion can be dehydrated. The paraffin then stays dissolved in the oil phase or at least sufficiently liquified.

The following example illustrates specific, non-limiting embodiment of the invention, including the best mode of practice of the invention.

EXAMPLE

A preferred mixture for the non-hazardous, non-flammable, biodegradable composition in accordance with the invention comprises the following:

- approximately $1/3^{rd}$ of a percentage point of weight percent of said limonene;
- approximately 3 weight percent of said ethylene glycol monopropyl ether;
- approximately 1 weight percent of said ethoxylated linear alcohol or ethoxylated oleyl alcohol surfactant, Ethal® LA-9 or Chemal® OA-9;
- approximately $1/3^{rd}$ of a percentage point of weight percent of said aliphatic alcohol having 1 to 4 carbon atoms or mixtures thereof, or more preferably methanol (or ethanol or mixtures of methanol and ethanol);
- approximately $1/3^{rd}$ of a percentage point of weight percent of acetic acid; and,
- approximately 95 weight percent of said water carrier.

Alternatively, the composition in accordance with the invention preferably can include water as much water as will sufficiently eliminate the flashpoint for the mixture to practically nothing. Hence depending on the desired use of the composition the ratios can be adjusted such that there is substantially less fractional amount of water than 95 weight percent.

The solubility of the foregoing mixture in water is substantially infinite. Given the most preferred composition as recited above, the inventive composition is substantially water, and thus it has no flash point and is substantially non-flammable. Whereas it has no pour point, it freezes at about 22° F. (−6° C.). However the composition's quality is not affected.

It has been found that the inventive composition shows outstanding characteristics in its ability to dissolve and disperse paraffin into an oil phase. In addition, the paraffin, so dispersed and dissolved, remains dispersed or dissolved (if the inventive composition is properly applied). The inventive composition is a multi-purpose product which can be used in applications as follows. In producing wells, it is useful for (i) down hole cleanout and (ii) clearing pump(s), tubing and flowlines of fouling. It also enhances the effectiveness of scale and corrosion inhibitors.

In heavy crude oil production, (i) it raises oil viscosity and allows increased flow from the well, (ii) it keeps paraffin build-up low, (iii) and it gives improved above-ground handling because of lower costs due to less heating of the oil to make it flow. In storage tank bottoms, (i) it softens tank bottoms so that they can be removed by pumping, (ii) which consequently eliminates digging out solid layers in the tank and so lowers the cost of removal, and also, (iii) the extra oil which is recoverable from the freed bottom sludge may be sufficient to cover the costs of cleaning the tank.

A more detailed description follows on the procedure in accordance with the invention for processing storage tank bottoms in accordance with trials using a composition having the fractional composition recited above. Preliminarily, experience shows that the general formulation of the accumulated deposition on the bottom of a storage tank can include the following:—I.) hydrocarbons (e.g., paraffins, waxes, and "heavy ends" such as asplialtenes, polynuclear aromatics, resins, and asphaltols), II.) water (e.g, emulsions and brine), and III.) inorganics (e.g., calcium/magnesium sulfates/carbonates, sand, clay and silicates, rust, chlorides).

A given storage tank may be assumed to have a nominal capacity of 80,000 barrels, in the bottom of which there is a sludge layer of about 5,000 bbl. The sludge might comprise up to 50% paraffins and heavy ends. Normal cleaning costs (not including cost of down time) might range around $150,000 or about $12.50 per bbl. of sludge. Hence, there is valuable recoverable petroleum crude locked in that sludge. Given the foregoing, the value of the extra oil (assuming a market price of $20 a bbl. of crude) computes according to the following:—5,000 bbl.×50%×$20/bbl., or $50,000. For comparison with normal cleaning costs, the cost of the recovered oil could exceed the cost of clean-out with the composition in accordance with the invention. Hence, the normal procedure costing something like $12.50 per bbl. could be converted into a marginal yield under the procedure in accordance with the invention. Also, the cost of the residue after extraction of the recoverable oil is completed is considerably less since the residue no longer contains hydrocarbons.

The general procedure for use of the inventive composition comprises the following steps for processing a tank bottom. Assume, once more, that the 5,000 bbl. sludge layer in the tank covers the bottom to a depth of 3 feet (1 m) or so. First, a crude oil layer is added to help dissolve and disperse the paraffin and heavy ends. Preferably about 1,000 bbl. of good crude is added to the tank, or a ratio of about 1:5 by volume of the sludge. Next about 5 bbl. of the composition in accordance with the invention is added. Hence the ratio of the crude oil carrier to the inventive composition in this example is 200:1. The admixture is allowed to stand for several hours. Then it is stirred or agitated for a cycle of several hours. Following that it is again allowed to rest, and after that then again agitated. These alternating cycles of agitate and rest are repeated as long as desired until by routine monitoring of softness of the bottom sludge the desired results are achieved. Ordinarily the elapsed time to a cycle of rest or agitate will extend between 2 and 8 hours, and the total elapsed time for completion of cleanout will extend between 8 and 48 hours. After the last agitation cycle. the tank contents are allowed to rest and settle once more. Following an elapse of time such that much of the good oil can fractionally separate itself, the good oil is siphoned from the top and piped to the refinery. That much of the water emulsion and sludge that is sufficiently liquified for pumping is hence pumped out. This procedure will clean the tank down to where most companies will accept what is left as acceptable.

Advantages of the process in accordance with the invention include the following. The inventive process eliminates digging out solid layers off tank bottoms. It saves time and manpower in that it can be accomplished in about one-third the normal time for digging out, and with much less of a crew. The tank is returned to service much sooner. The inventive process provides yields in recoverable oil previously locked up in the bottom sludge which might pay for, or at least partially offset the cost of clean out. The tank will ordinarily not require another comparable cleanout for a longer period of time, perhaps for up to 18 months to 2 years if the inventive composition is added in small doses during tank use to inhibit deposit formation. A recommended dosage level might be about 1 gallon of the inventive composition for each 1.000 gallons of oil.

As previously mentioned, the inventive composition is also useful for down hole treatment. In down hole treatment, the general procedure is to circulate the well for 24 hours with usually about 15 gallons of the inventive composition for 1,000 feet of fluids. In servicing flowlines with the inventive composition, they are treated with a chemical pump and adjusted accordingly as persons ordinarily skilled in the art through routine trial and error would succeed at.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A non-hazardous, non-flammable, biodegradable composition for use in removal of paraffin accumulations in oilfield equipment consisting essentially approximately of:

$1/3^{rd}$ of a percentage point of weight percent of limonene;

3 weight percent of a glycol ether or mixtures thereof;

1 weight percent an ethoxylated alcohol surfactant;

$1/3^{rd}$ of a percentage point of weight percent of an aliphatic alcohol having 1 to 4 carbon atoms or mixtures thereof;

$1/3^{rd}$ of a percentage point of weight percent of a non-hazardous and biodegradable organic acid; and, 95 weight percent of water as a carrier and comprising such a major weight component of the composition as to virtually eliminate a measurable flashpoint therefor.

2. The composition of claim 1 wherein said glycol ether is ethylene glycol monopropyl ether.

3. The composition of claim 1 wherein said ethoxylated alcohol surfactant is one of an ethoxylated lauryl alcohol or ethoxylated oleyl alcohol having approximately less than fifteen (15) units of ethylene oxide on each ethoxylated alcohol molecule.

4. The composition of claim 1 wherein said aliphatic alcohol is one of methanol, ethanol, or a mixture thereof.

5. The composition of claim 1 wherein the organic acid is chosen from a group consisting of acetic acid, formic acid and citric acid.

6. The composition of claim 5 wherein the organic acid is acetic acid.

7. A non-hazardous, non-flammable, biodegradable composition for use in removal of paraffin accumulations in oilfield equipment consisting essentially approximately of:

$1/3^{rd}$ of a percentage point of weight percent of limonene;

3 weight percent of ethylene glycol monopropyl ether;

1 weight percent of an ethoxylated lauryl alcohol or ethoxylated oleyl alcohol surfactant;

$1/3^{rd}$ of a percentage point of weight percent of an aliphatic alcohol having 1 to 4 carbon atoms or mixtures thereof;

$1/3^{rd}$ of a percentage point of weight percent of a non-hazardous and biodegradable organic acid that is choosen from a group consisting of acetic acid, formic acid and citric acid; and, 95 weight percent of water as a carrier and comprising such a major weight component of the composition as to virtually eliminate a measurable flashpoint therefor.

8. The composition of claim 7 wherein the organic acid is acetic acid.

9. The composition of claim 7 wherein said aliphatic alcohol is one of methanol, ethanol, or a mixture thereof.

10. The composition of claim 7 wherein said surfactant of an ethoxylated lauryl alcohol or ethoxylated oleyl alcohol has approximately less than fifteen (15) units of ethylene oxide on each ethoxylated alcohol molecule.

11. A non-hazardous, non-flammable, biodegradable composition for use in removal of paraffin accumulations in oilfield equipment consisting essentially of approximately:

$1/3^{rd}$ of a percentage point of weight percent of limonene;

3 weight percent of ethylene glycol monopropyl ether;

1 weight percent of an ethoxylated lauryl alcohol or ethoxylated oleyl alcohol surfactant;

$1/3^{rd}$ of a percentage point of weight percent of an aliphatic alcohol having 1 to 4 carbon atoms or mixtures thereof;

$1/3^{rd}$ of a percentage point of weight percent of acetic acid; and, 95 weight percent of water as a carrier and comprising such a major weight component of the composition as to virtually eliminate a measurable flashpoint therefor.

12. The composition of claim 11 wherein said aliphatic alcohol is one of methanol, ethanol, or a mixture thereof.

13. The composition of claim 11 wherein said surfactant of an ethoxylated lauryl alcohol or ethoxylated oleyl alcohol has approximately less than fifteen (15) units of ethylene oxide on each ethoxylated alcohol molecule.

14. A process for at least partially removing paraffinic accumulations and sludges from oilfield tanks comprising:

introducing and then alternating cycles of agitation and rest within a given oilfield tank an aqueous-based non-hazardous, non-flammable, biodegradable composition consisting essentially of limonene, ethylene glycol monopropyl ether, an ethoxylated lauryl alcohol or ethoxylated oleyl alcohol surfactant, an aliphatic alcohol having 1 to 4 carbon atoms or mixtures thereof, a non-hazardous and biodegradable organic acid; and, water as a carrier and comprising such a major weight component of the composition as to virtually eliminate a measurable flashpoint for the composition;

wherein said organic acid comprises one of acetic acid or citric acid;

wherein said aliphatic alcohol comprises of one of methanol, ethanol or a mixture thereof; and, wherein said composition essentially consists approximately of $1/3^{rd}$ of a percentage point of weight percent of said limonene; 3 weight percent of said ethylene glycol monopropyl ether; 1 weight percent of said ethoxylated lauryl alcohol or ethoxylated oleyl alcohol surfactant; $1/3^{rd}$ of a percentage point of weight percent of said methanol, ethanol or admixture therebetween, $1/3^{rd}$ of a percentage point of weight percent of either said acetic acid or said citric acid, and, 95 weight percent of said water carrier.

* * * * *